US007703150B2

(12) United States Patent
Wagner et al.

(10) Patent No.: US 7,703,150 B2
(45) Date of Patent: Apr. 27, 2010

(54) CHILD'S VEST

(76) Inventors: Julie G. Wagner, 587 Stonemarker Rd., Mooresville, NC (US) 28117; Charles F. Foley, 1934 Woodland Dr., Charlotte, NC (US) 28205-6354

( * ) Notice: Subject to any disclaimer, the term of this patent is extended or adjusted under 35 U.S.C. 154(b) by 1208 days.

(21) Appl. No.: 11/187,518

(22) Filed: Jul. 22, 2005

(65) Prior Publication Data

US 2007/0017001 A1 Jan. 25, 2007

(51) Int. Cl.
*A62B 35/00* (2006.01)

(52) U.S. Cl. ..... 2/102

(58) Field of Classification Search ..... 2/463, 2/102, 69, 456, 108, 44, 45, 92, 94; 297/465, 297/485

See application file for complete search history.

(56) References Cited

U.S. PATENT DOCUMENTS

| | | | | |
|---|---|---|---|---|
| 2,792,607 | A | 5/1957 | Packham | |
| 2,908,324 | A | 10/1959 | Muller et al. | |
| 2,932,869 | A | 4/1960 | Neubig | |
| 3,992,040 | A | 11/1976 | Gannac | |
| 4,062,065 | A | 12/1977 | Gardner | |
| 4,085,465 | A | 4/1978 | Brown | |
| 4,550,800 | A | 11/1985 | Dietrich | |
| 4,561,676 | A | 12/1985 | Trubiano | |
| 4,832,053 | A * | 5/1989 | McCarthy | 128/869 |
| D302,749 | S | 8/1989 | Marquez et al. | |
| 4,867,464 | A | 9/1989 | Cook | |
| 4,975,987 | A | 12/1990 | Teachout et al. | |
| 5,086,516 | A | 2/1992 | Baxter et al. | |
| 5,161,258 | A * | 11/1992 | Coltrain | 2/102 |
| 5,178,439 | A | 1/1993 | McCracken | |
| 5,203,613 | A | 4/1993 | Ward | |
| 5,263,726 | A | 11/1993 | Wood | |
| 5,301,371 | A | 4/1994 | Chao | |
| 5,325,818 | A | 7/1994 | Leach | |
| 5,335,957 | A | 8/1994 | Golder | |
| 5,429,418 | A * | 7/1995 | Lipper et al. | 297/465 |
| 5,468,020 | A | 11/1995 | Scime | |
| 5,628,548 | A | 5/1997 | Lacoste | |
| 5,641,200 | A | 6/1997 | Howell | |
| 5,815,834 | A | 10/1998 | Bronson | |
| 5,931,503 | A | 8/1999 | Glendon | |
| 5,943,697 | A | 8/1999 | Poskanzer | |
| 6,086,158 | A * | 7/2000 | Zeoli | 297/482 |
| 6,314,578 | B1 * | 11/2001 | Masuda et al. | 2/102 |
| 6,397,390 | B1 | 6/2002 | Henderson et al. | |
| 6,449,770 | B1 * | 9/2002 | Taylor et al. | 2/69 |
| 7,131,703 | B1 * | 11/2006 | Sheridan et al. | 297/465 |
| 2002/0188999 | A1 | 12/2002 | Haar et al. | |
| 2004/0221358 | A1 | 11/2004 | Briscoe et al. | |
| 2005/0017566 | A1 | 1/2005 | Rizk | |

* cited by examiner

*Primary Examiner*—Tejash Patel
(74) *Attorney, Agent, or Firm*—McCormick, Paulding & Huber LLP

(57) ABSTRACT

An inexpensive, multi-purpose, durable garment in the nature of a child's vest for general wear which easily accepts the shoulder strap of a vehicle seat belt system regardless of the child's seated position in the vehicle, is light in weight, easy to put on and take off, comfortable to wear, encourages the habit of seat belt use and is appealing and attractive to children.

15 Claims, 7 Drawing Sheets

CHILD'S VEST

BACKGROUND OF THE INVENTION

1. Field of the Invention

The present invention relates to a multi-purpose 'Silent Teacher' garment in the form of a vest which children of all ages are eager to wear and which easily accepts the shoulder strap of a vehicle seat belt system while allowing children to attach various articles such as toys, pockets and patches thereto for their enjoyment and to make statements concerning a variety of subjects, and which additionally encourages the children to develop the habit of 'Think Safety First', always using seat belt safety equipment in automobiles, shopping carts, or any moving vehicle.

2. Description of Related Art

"Click It Or Ticket!" is a concise phrase which summarizes the law regarding the mandatory use of vehicle seat belts in virtually every state of the United States and in many foreign countries.

The phrase also is applicable to the requirement under the law which requires that children 4 to 8 years of age, or under 80 pounds must be secured in a safety 'Booster' seat which is in turn secured relative to the vehicle seat by the vehicle seat belt system.

However, most children resent being tied down, dislike being treated like a baby, and battle against being restrained by any safety belt system, thereby causing stress between parent and child and resulting in serious injuries and even death to unrestrained children during motor vehicle accidents and in falls from shopping carts.

There are a wide variety of harnesses and garments in the prior art for wear by children for use with vehicle seat belt systems. However, most are expensive, cumbersome, difficult to put on or take off, uncomfortable to wear, fail to encourage good safety habits or seat belt use, and are not appealing or attractive to children.

In addition, while the prior art discloses garments to which various indicia may be applied, the garments have no utility in teaching the wearer to form good social habits and fail to impart a message which encourages seat belt use.

SUMMARY OF THE INVENTION

It is a primary object of the invention to provide an inexpensive, multi-purpose, durable garment in the nature of a child's vest for general wear which easily accepts the shoulder strap of a vehicle seat belt system, is light in weight, easy to put on and take off, comfortable and fun to wear, encourages the habit of seat belt use, and is appealing and attractive to children of all ages and genders.

Still further objects are to provide a multi-purpose 'Silent-Teacher' garment in the nature of a vest which children enjoy wearing, permits the use of replaceable indicia and/or patches which can be applied to the garment for identification purposes or to make them visible day or night, while allowing them to make statements concerning a variety of subjects, and which is specifically designed for use with the shoulder strap of a vehicle seat belt system.

As a salient feature, with the vest of the invention, the shoulder strap of the vehicle seat belt system is positioned properly so as to guard against chafing of the child's neck by the shoulder belt, whereby vehicle seat belt systems are more comfortable to wear.

With the invention hereof, the vest is provided with primary and secondary restraining and guiding means for properly locating and restraining the vehicle shoulder strap which is passed therethrough in either left to right or right to left directions, with the primary restraining and guiding means being disposed on each shoulder of the vest and the secondary restraining and guiding means being disposed at a central, mid-sternum location on the front of the vest.

The primary restraining and guiding means preferably comprises a VELCRO flap fabricated from a soft, fluffy hook and loop material which is fixed adjacent one of its ends to each shoulder of the vest and which is releasably engageable adjacent its opposite end with a VELCRO strip fabricated from rough hook and loop material fixed to each shoulder of the vest, with the flap confining the shoulder strap of a seat belt system positioned therebelow and holding the shoulder strap away from the neck of the wearer of the vest.

The soft, fluffy hook and loop material of the primary restraining and guiding means serves to cushion the clavicle of the wearer from the constant rubbing of the shoulder strap while guarding against possible chafing of the neck of the wearer of the vest by the shoulder strap of the vehicle seat belt system.

The secondary restraining and guiding means is located on the front of the vest so as to be positioned at a point mid-sternum of the wearer and comprises a snap fastener system wherein a strap having snap fasteners fixed to each end is releasably engaged with spaced snap fasteners fixed to the vest, with the strap serving to maintain the proper slope of the seat belt system shoulder strap from mid-clavicle at the primary restraining and guiding means, to and across the lower mid-sternum of the wearer to the hip of the wearer for engagement with the vehicle seat belt system.

The snap fasteners are so positioned relative to the longitudinal central axis of the vest that the strap of the secondary restraining and guiding means may be changed easily from left to right or right to left orientation to accept the vehicle shoulder strap regardless of where the wearer of the vest is seated in the vehicle.

As additional features of the invention which make the vest attractive to children, press-on, zip-off patch pockets of varying sizes, patterns, or themes for carrying miscellaneous items may be attached to the front of the vest by VELCRO strips fabricated from hook and loop material provided on the pockets and on the vest, and snap hooks are provided for securing favorite toys and trinkets to the garment.

The vest of the invention is preferably fabricated from a durable, resilient, stain-resistant, fire-resistant, machine washable fabric such as duck cloth, and includes elastic side panels for providing a snug fit while permitting expansion for comfort.

The vest may be white or any other desired color such as military for army, navy, marines or air force, camouflage, or hunter's blaze orange to aid in locating a lost child wearing the vest, while making the vest highly visible day or night.

Fastening means, such as a zipper, buttons or the like is positioned on the front of the garment to permit the vest to be put on and taken off with ease, while piping is provided on the arm and neck openings of the vest for wearer comfort.

As an additional safety feature, a double-ring tether strap is provided on the back of the vest for use in securing the child in a shopping cart and may include an optional hand loop to assist an adult in holding a child back from dangerous situations.

DETAILED DESCRIPTION OF THE PREFERRED EMBODIMENTS

Figure 1A:
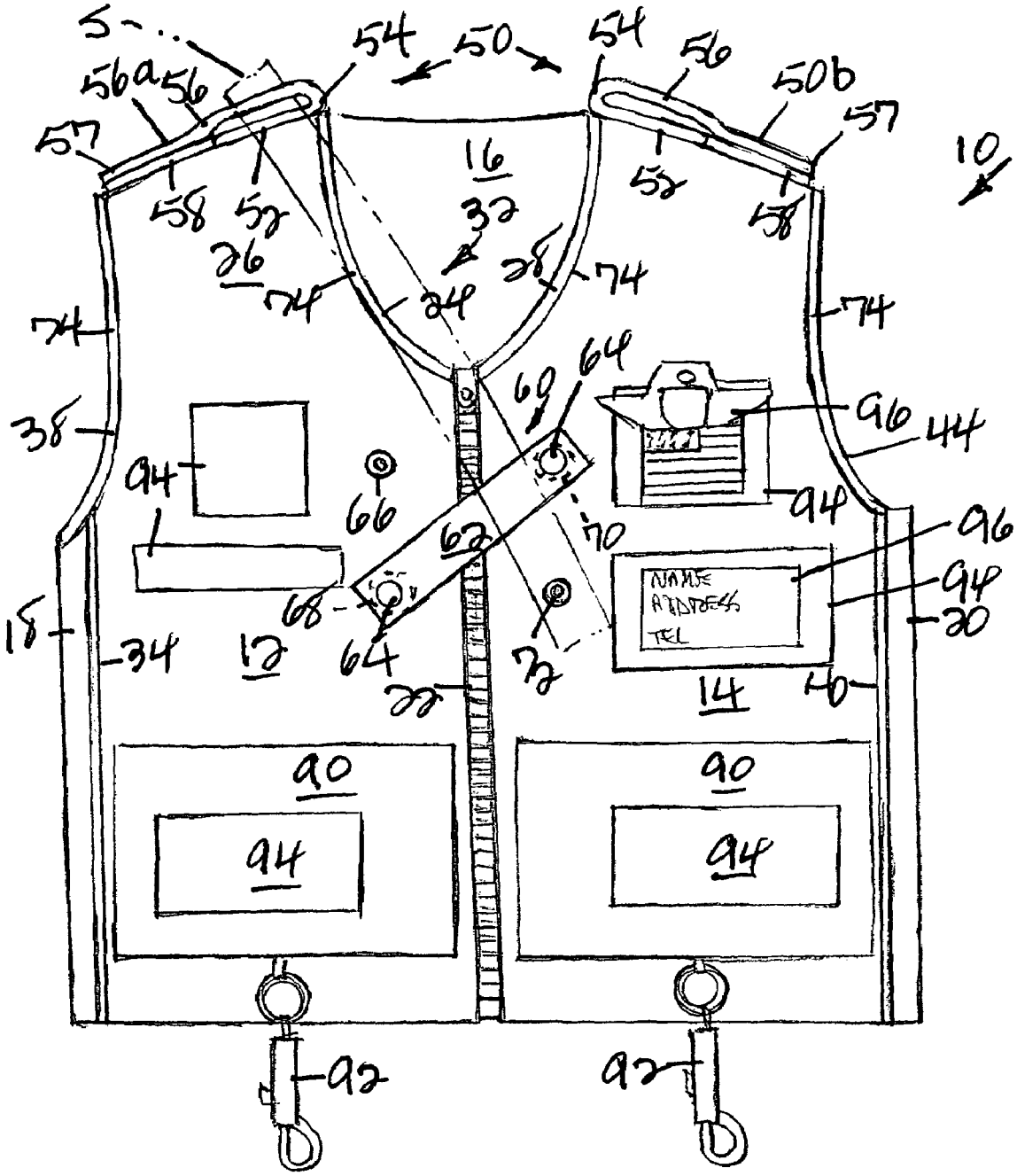
FIG. 1A is a front elevational view of a child's vest embodying a preferred form of the invention arranged for left to right vehicle shoulder strap orientation.

With reference to the drawings, a child's vest generally indicated by 10 embodying a preferred form of the invention is preferably sleeveless and includes a pair of left and right front panels 12 and 14, respectively, and a rear panel 16 fabricated from any suitable durable, resilient, stain-resistant, fire-resistant, machine washable fabric such as duck cloth, and a pair of left and right elasticized side panels 18 and 20, respectively, fabricated from any suitable stretchable, elastic material for providing a snug fit while permitting expansion for comfort when the vest is worn.

The adjacent inner side edges of front panels 12 and 14 are releasably fastened together by a zipper 22 located centrally of vest 10, although other fastening means such as buttons or the like, not shown, may be used.

An upper, inner side edge 24 of a left shoulder portion 26 of left front panel 12 curves outwardly and upwardly above zipper 22.

Figure 4:
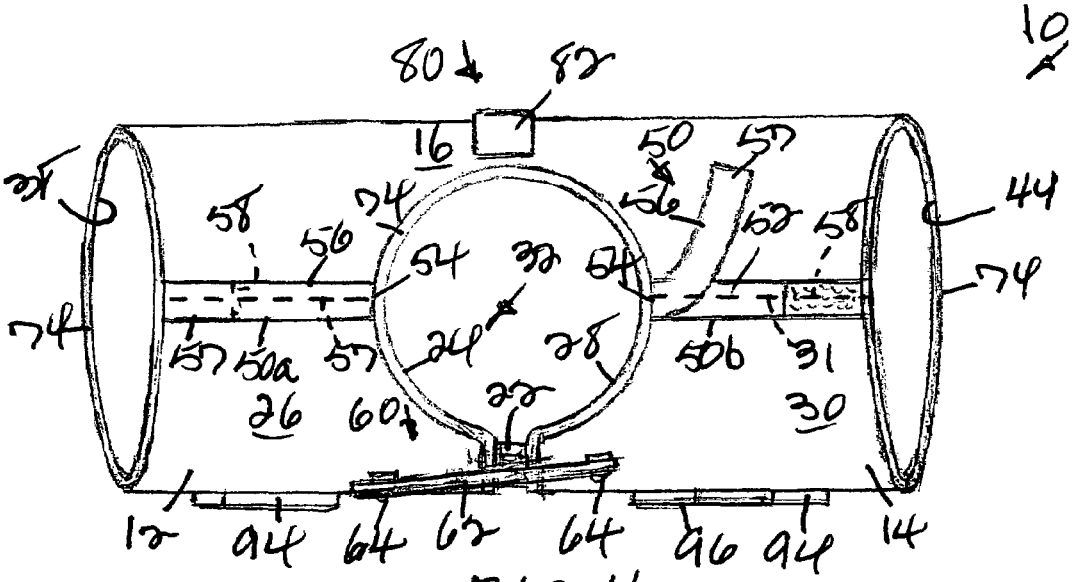
FIG. 4 is a top plan view of the child's vest of FIG. 1A.
Figure 5:
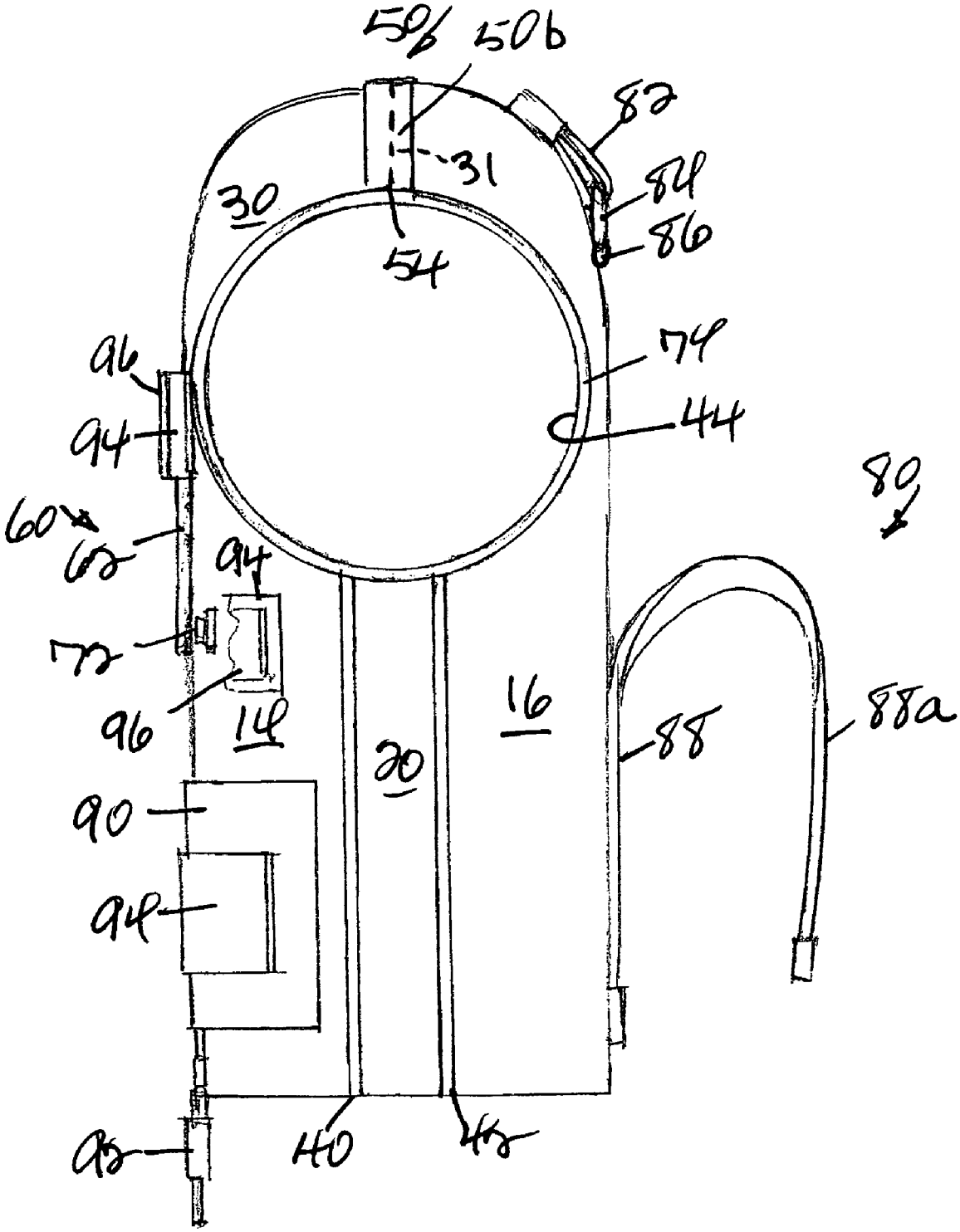
FIG. 5 is a right side elevational view of the child's vest of FIG. 1A.
Figure 6:
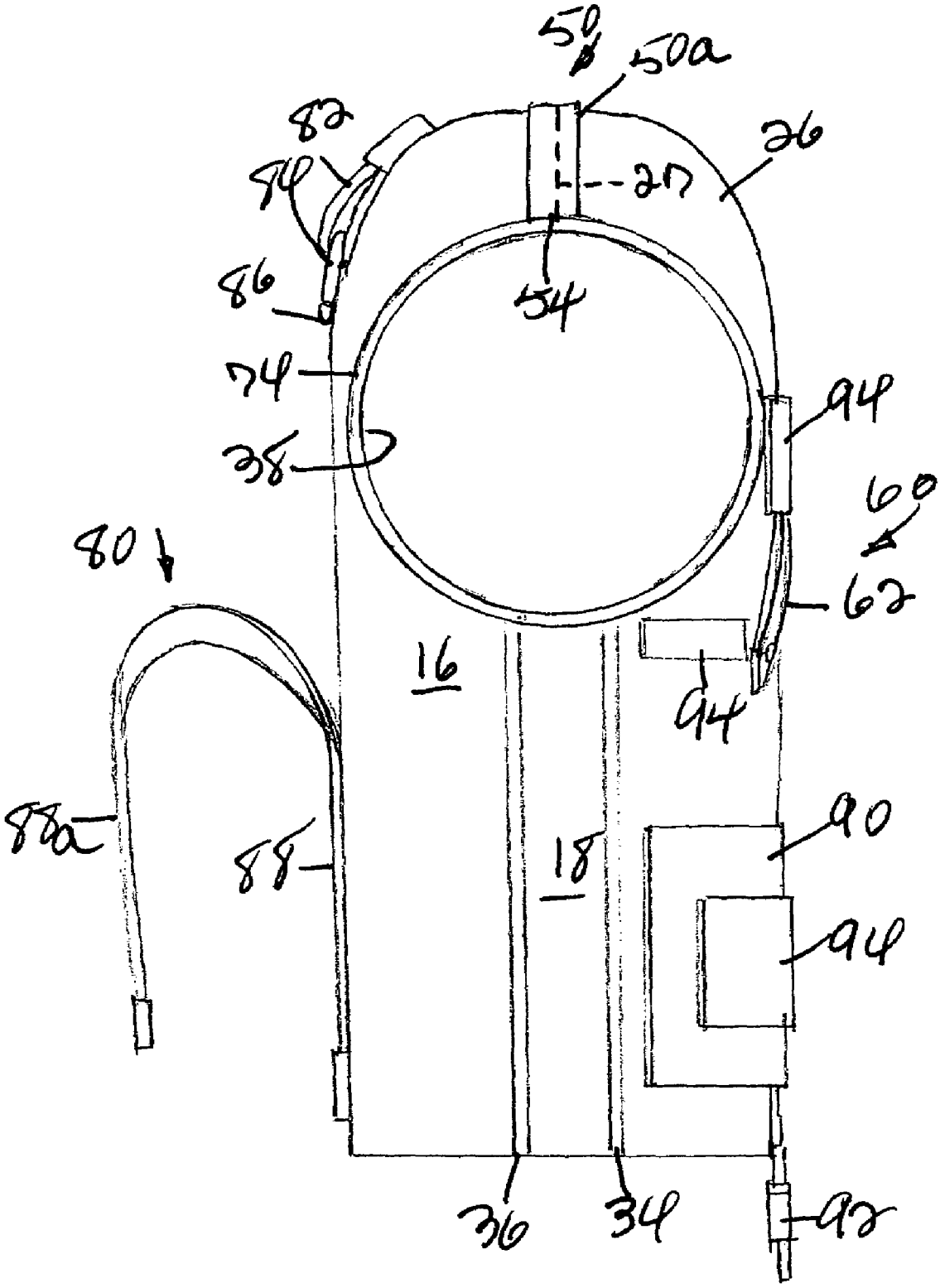
FIG. 6 is a left side elevational view of the child's vest of FIG. 1A.

As best seen in FIG. 4, an upper edge of left shoulder portion 26 is joined to an upper edge of an adjacent upper edge of rear panel 16 to form a seam 27.

An upper, inner side edge 28 of a right shoulder portion 30 of right front panel 14 curves outwardly and upwardly above zipper 22.

An upper edge of right shoulder portion 30 is joined at its upper edge to an adjacent upper edge of rear panel 16 to form a seam 31, as shown in FIG. 4.

The curved, upper, inner edges 24 and 28 of the shoulder portions of front panels 12 and 14 together define a neck opening generally indicated by 32 for vest 10.

Left side panel 18 extends longitudinally for approximately one-half the length of each of left front panel 12 and rear panel 16 and is joined at its outer edges to a lower portion of an outer edge 34 of the left front panel and to a lower portion of a first outer edge 36 of rear panel 16.

The upper portions of left front panel 12 and rear panel 16 are not joined together at their outer edges which curve inwardly and upwardly above left side panel 18 with identical curvatures to form a left arm opening 38 for vest 10.

Right side panel 20 extends longitudinally for approximately one-half the length of each of right front panel 14 and rear panel 16 and is joined at its outer edges to a lower portion of an outer edge 40 of the right front panel and to a lower portion of a second outer edge 42 of rear panel 16.

The upper portions of right front panel 14 and rear panel 16 are not joined together at their outer edges which curve inwardly and upwardly above right side panel 20 with identical curvatures to define a right arm opening 44 for vest 10.

Figure 1B:
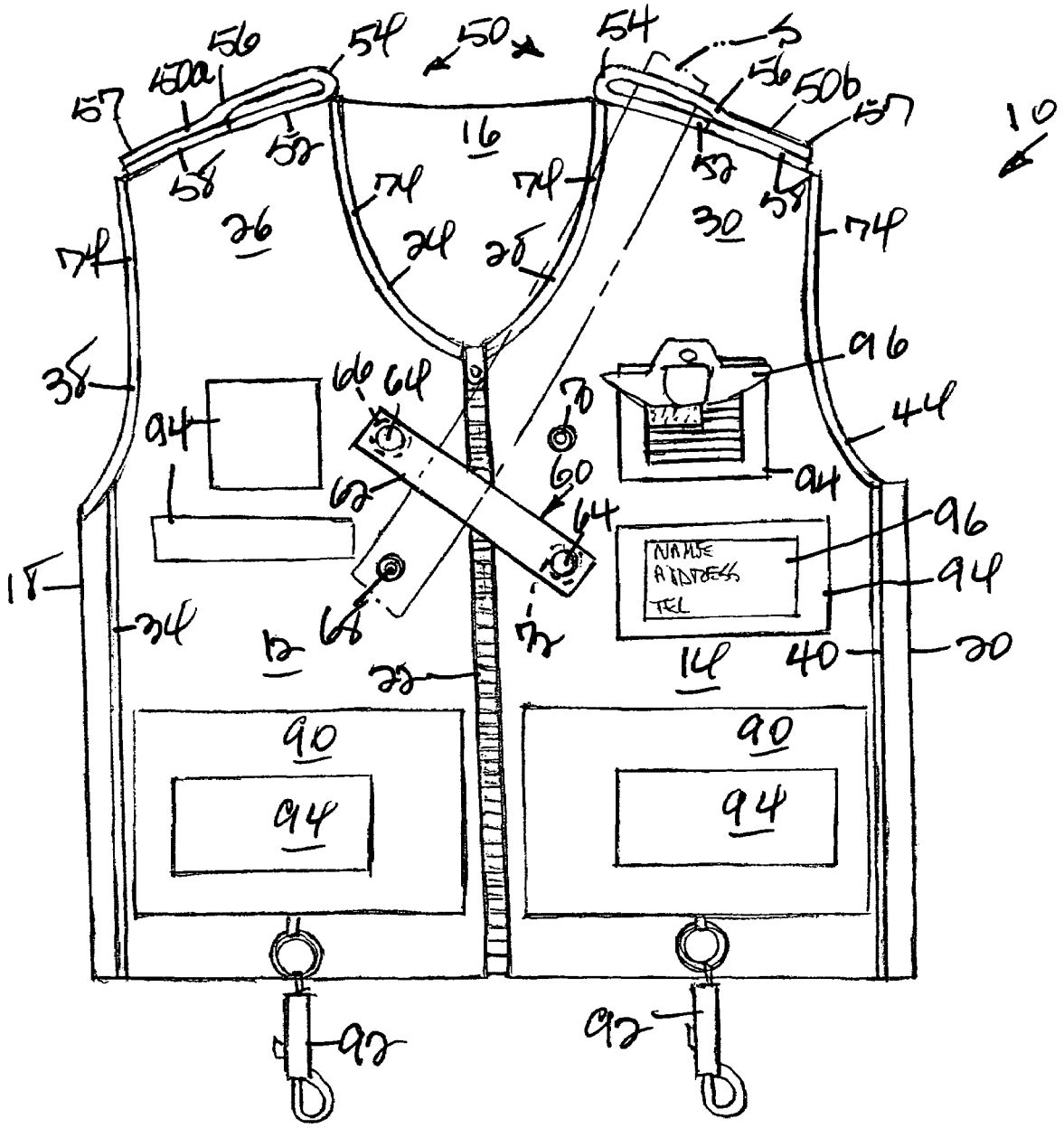
FIG. 1B is a front elevational vies of a child's vest embodying a preferred form of the invention arranged for right to left vehicle shoulder strap orientation.

Vest 10 is provided with primary and secondary restraining and guiding means, generally indicated by 50 and 60 respectively, for properly locating and restraining a vehicle shoulder strap S which is passed therethrough, as shown fragmentarily and in phantom in FIG. 1A and FIG. 1B.

Primary restraining and guiding means 50 includes a pair of identical, generally rectangular, left and right VELCRO flaps, 50*a* and 50*b* respectively, positioned so as to be disposed mid-clavicle of the wearer on each side of neck opening 32 and fabricated from a soft, fluffy hook and loop material.

Flap 50*a* extends along seam 27 on left shoulder portion 26 of left front panel 12.

Flap 50*b* extends along seam 31 on right shoulder portion 30 of right front panel 14.

Each flap 50*a* and 50*b* is generally U-shaped in front elevation and includes a base member 52 which is fixed to its respective shoulder portion 26 or 30 and is bent or curled over on itself adjacent one of its ends to form a hinge 54 and to provide an upper member 56 which is pivoted to the base member 52 adjacent neck opening 32.

Upper members 56 are of greater length than base members 52 whereby an outer end portion 57 thereof overlies and is releasably engageable with VELCRO strips 58 fabricated from hook and loop material positioned adjacent the outer ends of each base member.

In use, vehicle shoulder strap S is inserted between base member 52 and upper member 56 of either flap 50*a*, as shown in FIG. 1A, or flap 50*b*, as shown in FIG. 1B, and is restrained from lateral or side-to-side movement in either direction by hinge 54 and the interengagement of the hook and loop material of outer end portion 57 with the hook and loop material of VELCRO strip 58.

Vehicle shoulder strap S may be released from flap 50*a* or flap 50*b* by releasing outer end portion 57 of upper member 56 from its engagement with strip 58 and pivoting the upper member upwardly relative to hinge 54 to a position as shown in FIG. 4 to permit removal of the shoulder strap.

Primary restraining and guiding means 50 guides vehicle shoulder strap S angularly downwardly therefrom to secondary restraining and guiding means 60 which is located on the front of vest 10 so as to be positioned at a point mid-sternum of the wearer.

Secondary restraining and guiding means 60 comprises a snap fastener system which includes a strap 62 having snap fasteners 64 at its opposite ends which are selectively and releasably engageable with any of spaced, upper and lower snap buttons 66 and 68 respectively fixed to left front panel 12 or spaced, upper and lower snap buttons 70 and 72 respectively fixed to right front panel 14.

Upper and lower snap buttons 66 and 68 respectively, are spaced outwardly of zipper 22 on left front panel 12 and are vertically aligned with each other and with the zipper, while upper and lower snap buttons 70 and 72 respectively, are spaced outwardly of zipper 22 on right front panel 14 and are vertically aligned with each other and with the zipper so as to define a somewhat box-like configuration.

In a first position of use as shown in FIG. 1A, snap fasteners 64 of strap 62 are releasably engaged with lower snap button 68 on left front panel 12 and upper snap button 70 on right front panel 14 so that the strap extends diagonally upwardly between the snap buttons in a left to right direction across zipper 22 in order to guide and restrain shoulder strap S as it passes thereunder from left flap 50*a* for engagement with the vehicle seat belt, not shown.

In a second position of use as shown in FIG. 1B, snap fasteners 64 of strap 62 are releasably engaged with lower snap button 72 on right front panel 14 and upper snap button 66 on left front panel 12 so that the strap extends diagonally upwardly between the snap buttons across zipper 22 in order to guide and restrain vehicle shoulder strap S as it passes thereunder from right flap 50*b* for engagement with the vehicle seat belt, not shown.

With such an optional positioning of strap 62, vehicle shoulder strap S is guided and restrained regardless of whether the vehicle shoulder strap extends over the left or right shoulder of the wearer and regardless of where the wearer is seated in the vehicle.

Strap 62 serves to maintain the proper slope of vehicle shoulder strap S from mid-clavicle at primary guiding and restraining means 50, to and across the mid-sternum of the wearer at secondary restraining and guiding means 60, and to the hip of the wearer for engagement with the vehicle seat belt system.

For wearer comfort, piping 74 is applied to neck opening 32 and to left and right arm openings, 38 and 44 respectively.

Figure 2:
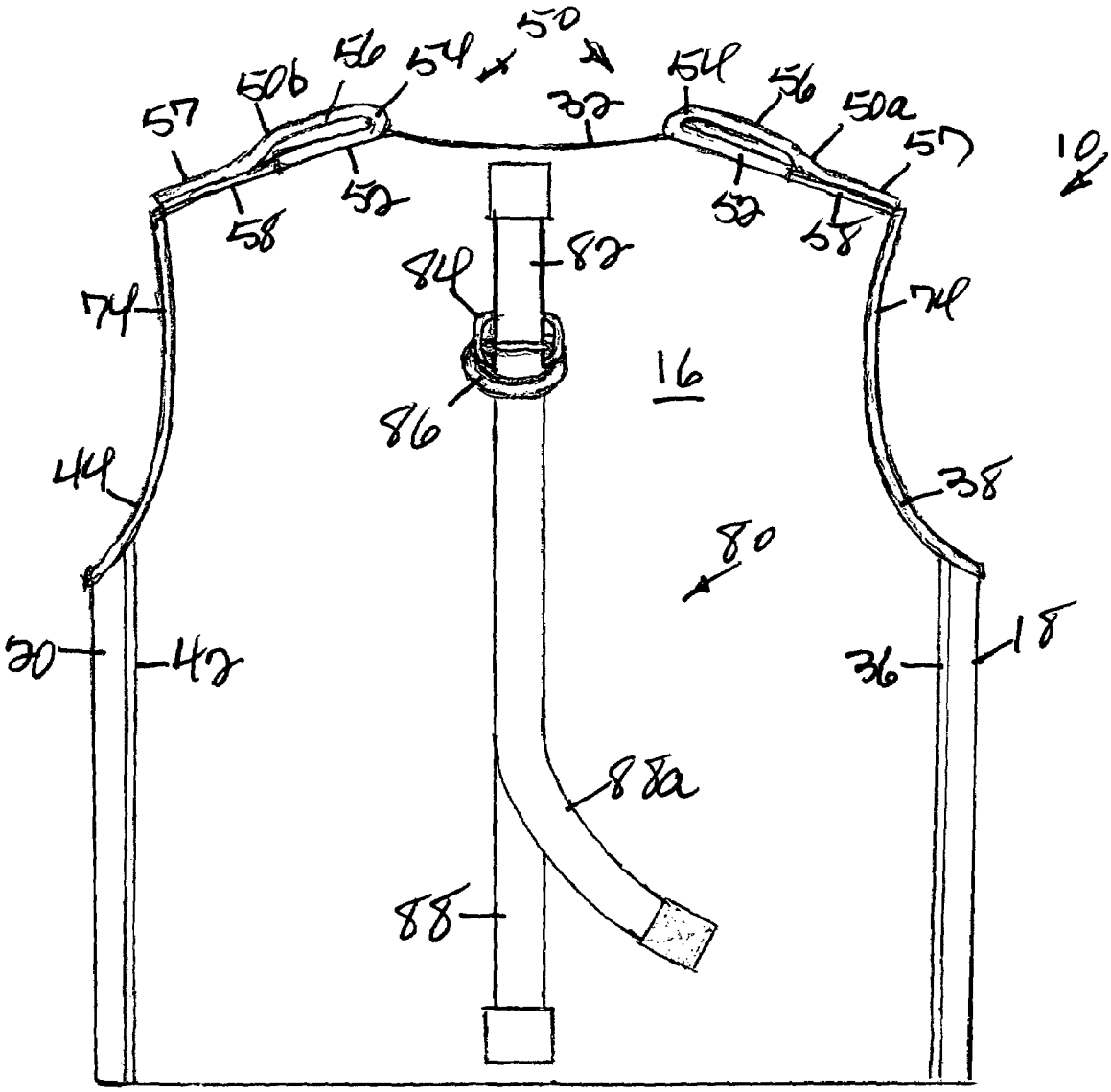
FIG. 2 is a rear elevational view of the child's vest of FIG. 1A and showing a double ring tether strap in a secured position.
Figure 3:
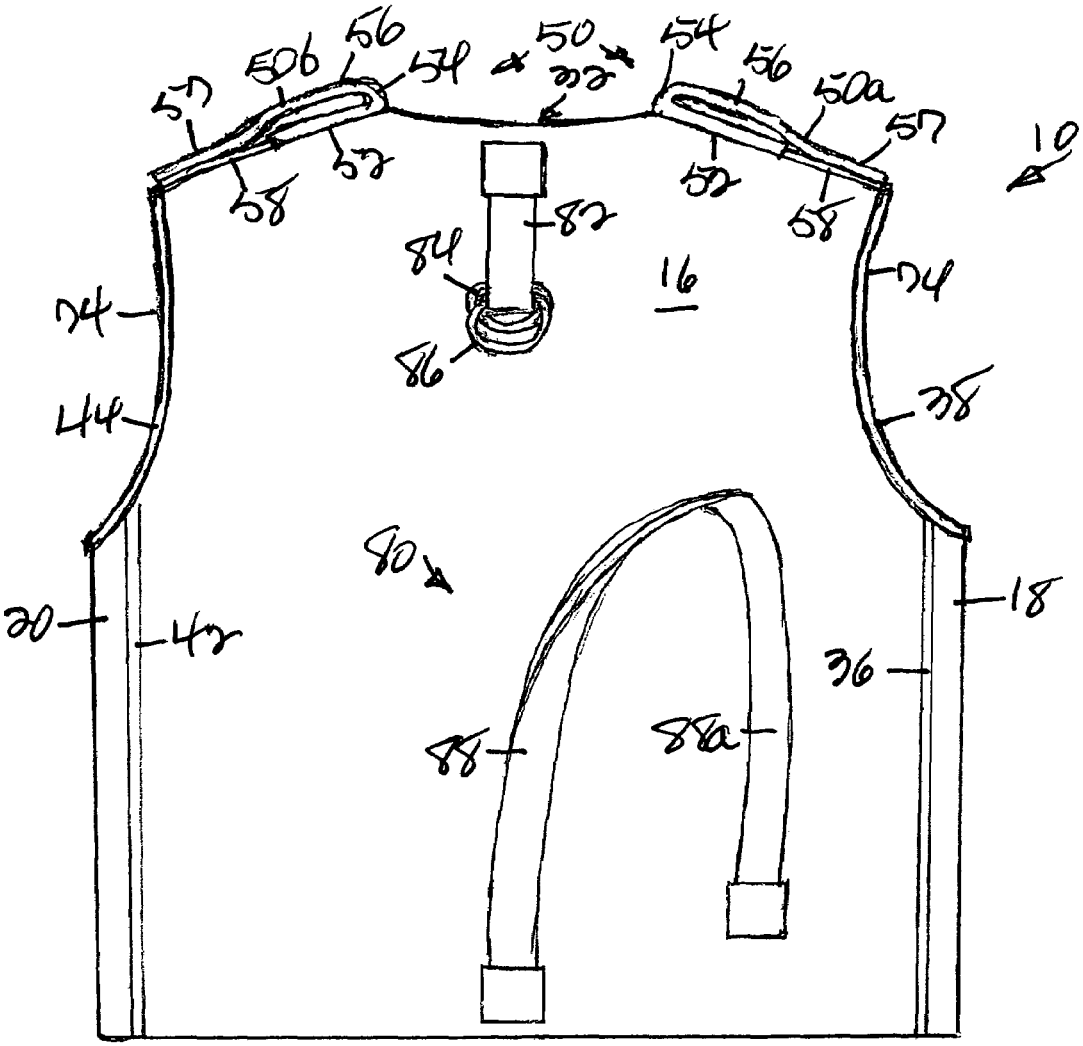
FIG. 3 is a rear elevational view similar to FIG. 2 showing the double ring tether strap in an unsecured position.

As an additional safety feature, vest 10 is provided with a tether strap system generally indicated by 80, best seen in FIGS. 2 and 3, positioned on the central, longitudinal axis of rear panel 16 for use in securing a child in such as a shopping cart or the like, not shown.

Tether strap system 80 includes a short strap 82 fixed at its upper end to rear panel 16 immediately below neck opening 32 and having a pair of O-rings 84 and 86 suspended from its lower end and a long strap 88 fixed at its lower end to rear panel 16 immediately above the lower edge of the rear panel.

A free end 88*a* of long strap 88 is threaded between O-rings 84 and 86 and is looped back on itself for releasably interengaging long strap 88 with short strap 82, as shown in FIG. 2.

As seen in FIG. 3, free end 88*a* of long strap 88 may be disengaged from O-rings 84 and 86 so that the long strap may be attached to such as a shopping cart seat, not shown.

Tether strap system 80 may also include a hand loop, not shown, to assist an adult in pulling a child back from dangerous situations.

Pockets 90, which may be of varying sizes, are fixed or optionally releasably attached to left and right front panel 12 and 14 respectively for carrying various articles and have snap fasteners 92 suspended therefrom for releasably securing favorite toys, trinkets or other paraphernalia to vest 10.

Strategically located VELCRO patches 94 fabricated from hook and loop material, which may be of various sizes, are fixed to pockets 90 and to the front panels of vest 10 for accommodating accessories 96, such as awards, emblems insignia, identification/medical tags, reflective or glow-after-dark patches, or the like which relate to areas of safety or are of interest to the child and the child's parents, with the accessories 96 being backed by suitable hook and loop material, not shown.

Figure 7:
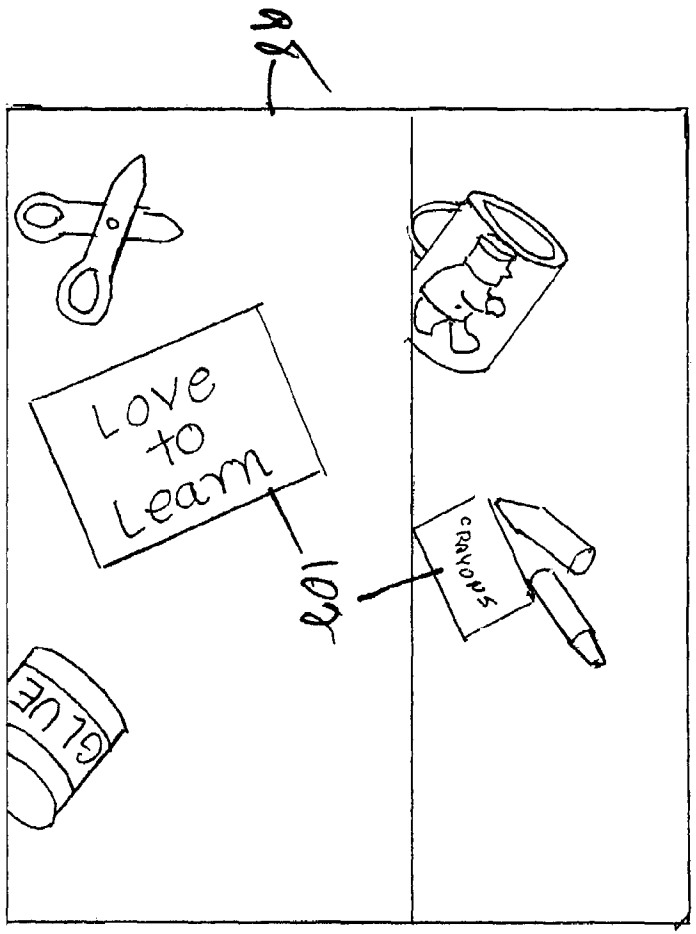
FIG. 7 is a front elevational view of a supplemental pocket for use with the child's vest of the invention.
Figure 8:
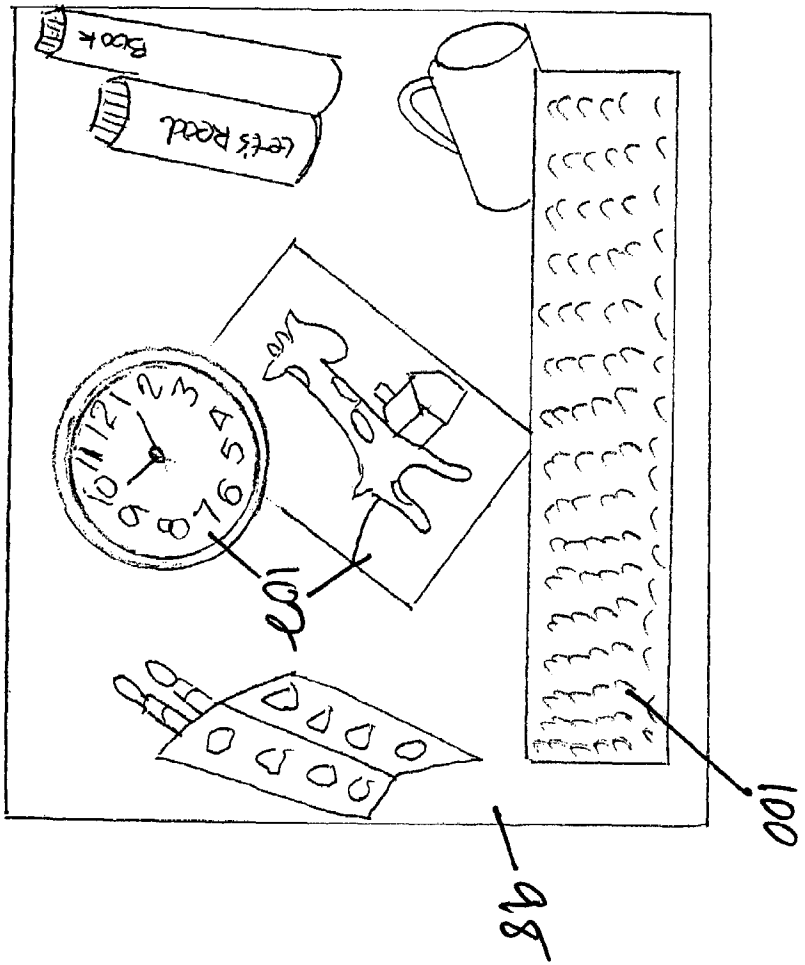
FIG. 8 is a rear elevational view of the supplemental pocket of FIG. 7.

Supplemental pockets 98 of the type as shown in FIGS. 7 and 8, backed by one or more VELCRO strips 100, fabricated from hook and loop material are also provided for carrying miscellaneous items and for releasable attachment to any one of VELCRO patches 94. Several such supplemental pockets, having miscellaneous indicia or designs 102 thereon, can be provided in various colors, patterns or themes as desired by the child or parent.

It should be understood that while it is preferred to use VELCRO flaps fabricated from hook and loop material such as flaps 50*a* and 50*b* in primary guidance and restraining means 50, the flaps may be replaced by a strap and snap fastener system on each shoulder of vest 10 similar to the strap and snap button system employed in secondary guidance and restraining means 60.

Similarly, the strap and snap button system employed in secondary guidance and restraining means 60 may be replaced by a VELCRO strap system employing hook and loop material.

What is claimed is:

1. A multi-purpose garment for use with an existing vehicle seatbelt system comprising a child's vest having a pair of front panels, means interconnecting the front panels, a shoulder portion on each front panel and a primary guide means on each shoulder portion for accommodating a vehicle shoulder strap of the seatbelt system extending thereunder at the mid-clavicle of the wearer, each said primary guide means having a pivotal connection with each said shoulder portion so as to open away from the neck of the wearer and to urge the vehicle shoulder strap angularly downward and away from the neck of the wearer, a first pair of anchoring means positioned on one of said front panels on a first side of the interconnecting means, and a second pair of anchoring means positioned on the other of said front panels on a second side of the interconnecting means, and secondary guide means selectively and releasably connected to one of said anchoring means of each pair of anchoring means on each front panel and extending across the interconnecting means at a point located at the lower mid-sternum of the wearer for accommodating the vehicle shoulder strap extending thereunder from the primary guide means according to the child's seated position in the vehicle.

2. A multi-purpose garment according to claim 1, wherein the secondary guide means extends angularly across the interconnecting means.

3. A multi-purpose garment according to claim 1, wherein the means interconnecting the front panels is a zipper.

4. A multi-purpose garment according to claim 1, wherein the first and second pairs of anchoring means are snap buttons and wherein the secondary guide means is a strap having snap fasteners releasably engageable with the snap buttons.

5. A multi-purpose garment according to claim 1, wherein each primary guide means comprises a flap fabricated from hook and loop material pivoted adjacent one of its ends to each shoulder portion so as to open away from the neck of the wearer and releasably engaged adjacent an opposite end with a strip fixed to each shoulder portion and fabricated from hook and loop material for providing a reversed opening when the flap is engaged with the strip for preventing the vehicle shoulder strap from rubbing against the neck of the wearer and for directing the vehicle shoulder strap in proper downwardly directed alignment to the secondary guide means.

6. A multi-purpose garment according to claim 5, wherein each flap is fabricated from a soft fluffy material for cushioning the shoulder of the wearer of the vest.

7. A multi-purpose garment according to claim 1, wherein the primary guide means and the secondary guide means on the front panels guide the vehicle shoulder strap away from the neck of the wearer.

8. A multi-purpose garment for use with an existing vehicle seatbelt system comprising a child's vest suitable for general wear having primary restraining and guiding means disposed on each shoulder of the vest located mid-clavicle of the wearer and oriented so as to open away from the neck of the wearer of the vest and secondary restraining and guiding means disposed on the front of the vest and located lower mid-sternum of the wearer of the vest, all for properly locating and restraining the vehicle shoulder strap of the vehicle seatbelt system passed therethrough and for preventing chafing of the neck of the wearer by the shoulder strap, each of said primary and secondary restraining and guiding means being adjustable to allow passage of said vehicle shoulder strap therethrough in either left to right or right to left directions to accommodate to the child's seated position in the vehicle.

9. A multi-purpose garment according to claim 8, wherein the primary restraining and guiding means comprises a flap fabricated from hook and loop material fixed adjacent one of its ends to each shoulder of the vest and releasably engaged adjacent an opposite end with a strip, fabricated from hook and loop material, each flap being fabricated from a soft fluffy material for cushioning the shoulder of the wearer against rubbing by the vehicle shoulder belt.

10. A multi-purpose garment according to claim 8, wherein the vest includes a pair of front panels interconnected by a zipper, a rear panel, a first elasticized side panel connected to the rear panel and to one of the front panels and a second elasticized side panel connected to the rear panel and to the other front panel.

11. A multi-purpose garment according to claim 10, including a vertically oriented double-ring tether strap disposed on the rear panel of the vest for securing the wearer in a shopping cart.

12. A multi-purpose garment according to claim 10, including pockets on the front panels, replaceable indicia or patches for identification or safety purposes and, means for releasably attaching the indicia or patches to the front panels or to the pockets and snap hooks on the front panels for securing toys, trinkets and other paraphernalia to the vest.

13. A multi-purpose garment according to claim 10, wherein the front and rear panels are fabricated from a durable, resilient, stain-resistant, fire-resistant, machine washable fabric.

14. A multi-purpose garment according to claim 10, including supplemental pockets in various colors, patterns or themes for releasable attachment to the vest.

15. A multi-purpose child's garment for general wear and for use with an existing vehicle seatbelt system comprising a vest having a front portion and a pair of shoulder portions, primary restraining and guiding means disposed on each said shoulder portion, comprising a flap pivoted adjacent one of its ends to each said shoulder portion adjacent the neck of the wearer of the vest and releasably engaged adjacent an opposite end with a strip spaced therefrom on each said shoulder portion, and secondary restraining and guiding means comprising a strap and fastener system fixed to and so located on the front portion of the vest as to be positioned at a point lower mid-sternum of the wearer of the vest, all for properly locating and restraining a vehicle shoulder strap of the vehicle seatbelt system which is passed therethrough and for preventing chafing of the neck of the wearer by the shoulder strap.

* * * * *